US008982005B2

(12) United States Patent
Tu

(10) Patent No.: US 8,982,005 B2
(45) Date of Patent: Mar. 17, 2015

(54) MONOPOLE SLOT ANTENNA STRUCTURE

(75) Inventor: Shu-Yang Tu, New Taipei (TW)

(73) Assignees: Inventec Appliances (Pudong) Corporation, Shanghai (CN); Inventec Appliances Corp., New Taipei (TW); Inventec Appliances (Jiangning) Corporation, Nanjing (CN)

( * ) Notice: Subject to any disclaimer, the term of this patent is extended or adjusted under 35 U.S.C. 154(b) by 265 days.

(21) Appl. No.: 13/452,930

(22) Filed: Apr. 22, 2012

(65) Prior Publication Data

US 2012/0326936 A1 Dec. 27, 2012

(30) Foreign Application Priority Data

Jun. 21, 2011 (CN) ..... 2011 1 0166829

(51) Int. Cl.
*H01Q 13/10* (2006.01)

(52) U.S. Cl.
CPC ..... *H01Q 13/10* (2013.01)
USPC ..... 343/767

(58) Field of Classification Search
CPC ..... H01Q 13/10; H01Q 13/085; H01Q 1/38; H01Q 13/18; H01Q 13/106
USPC ..... 343/767, 700 MS, 702, 845–848
See application file for complete search history.

(56) References Cited

U.S. PATENT DOCUMENTS

| | | | | |
|---|---|---|---|---|
| 6,466,170 | B2 * | 10/2002 | Zhou | 343/700 MS |
| 6,466,176 | B1 * | 10/2002 | Maoz et al. | 343/767 |
| 6,683,517 | B2 * | 1/2004 | Chiu et al. | 333/243 |
| 6,762,723 | B2 * | 7/2004 | Nallo et al. | 343/700 MS |
| 7,295,160 | B2 * | 11/2007 | Purr et al. | 343/700 MS |
| 8,560,029 | B2 * | 10/2013 | Ash et al. | 455/575.7 |
| 2006/0071857 | A1 * | 4/2006 | Pelzer | 343/700 MS |

* cited by examiner

*Primary Examiner* — Huedung Mancuso
(74) *Attorney, Agent, or Firm* — Novak Druce Connolly Bove + Quigg LLP

(57) ABSTRACT

A monopole slot antenna structure including a dielectric substrate, a monopole slot antenna and a feed element is provided. The monopole slot antenna is disposed on one side of the dielectric substrate and has a slot including a first slot section, a tuning slot section and a second slot section. One end of the first slot section is located at one edge of the monopole slot antenna with the other end of the first slot section being extended towards internal portions of the monopole slot antenna and being connected to the tuning slot section. One end of the second slot section is connected to the tuning slot section with the other end of the second slot section being extended away from the first slot section. The feed element is disposed correspondingly to the second slot section, and excites the monopole slot antenna to generate two operating frequency bands.

8 Claims, 5 Drawing Sheets

MONOPOLE SLOT ANTENNA STRUCTURE

CROSS-REFERENCE TO RELATED APPLICATION

This application claims the priority benefit of China application serial no. 201110166829.5, filed on Jun. 21, 2011. The entirety of the above-mentioned patent application is hereby incorporated by reference herein and made a part of this specification.

BACKGROUND OF THE INVENTION

1. Field of the Invention

The invention relates to a monopole slot antenna structure, and particularly relates to a monopole slot antenna structure having a tuning slot section for conveniently adjusting suitable frequencies, and the monopole slot antenna structure being capable of operating in dual-frequency environment.

2. Description of Related Art

As Internet develops vigorously, various kinds of network platform services, such as networked communication platforms (for example, message boards, forums, community websites and so forth) or data exchange platforms (for example, web albums, official download spaces, networked space and so forth) or personal service platforms (for example, electronic mailboxes, blogs, web games and so forth), all have been involved with everyone's lives. As such, these network platform services make it convenient for people to obtain necessary data when they are at home or in working environments. In particular, prevalence of wireless communications revolves the problem in which people can only use Internet in a particular area due to length limitations of physical connections. Therefore, communication devices with wireless communication functionality such as mobile phones, personal digital assistants (PDA) or tablet computers have gradually become necessity in people's lives.

Accordingly, in current communication devices, Wi-Fi™, one of most commonly used wireless communication protocol standards, is based on IEEE 802.11 standards. Wi-Fi™ operates in 2.4 GHz frequency band (802.11 b/g/n) and 5 GHz frequency band (802.11 a/n). Since people mainly require exterior designs of communication devices to be light, slim, short and small, vendors mainly concern simplification of electronic components or shortening of built-in antenna length in design of communication devices supporting Wi-Fi™, in order to meet the aforementioned design requirements. In general, most of the vendors currently apply a monopole antenna as the built-in antenna of the communication devices since the monopole antenna has simple structure and its resonance frequency is a quarter of wavelength of the operating frequency. As such, the length of the monopole antenna is shorter. An electric current generated in a closed loop due to potential difference on the antenna makes the antenna function normally. Thus, the ground point of the electric circuit board or the body of the electronic device are usually taken as a reference ground plane of the monopole antenna. Nonetheless, any electronic components or conductors closer to the monopole antenna may influence the monopole antenna, such as forming a closed electric circuit accidentally. As such, signal quality of the electromagnetic signals received by the monopole antenna may be poor. Thus, in order to maintain good antenna functionality, the vendors seem to allocate a larger clearance area around the monopole antenna, but such allocation design will greatly increase an overall volume of the communication device.

In order to resolve the monopole antenna being too sensitive or easily influenced by surrounding objects, some vendors attempt to use a slot antenna to be the antenna of the communication device operating in dual-frequencies, since the slot antenna is not easily influenced by neighbouring electronic components or conductors. As such, it is not necessary for the vendors to allocate an additionally larger clearance area around the slot antenna. However, the resonance frequency of the slot antenna is a half of the wavelength of the operating frequency. Thus, the required antenna length is far greater than that of the monopole antenna, for example, under the same operating frequency, the length of the slot antenna is twice of that of the monopole antenna, so the overall volume of the communication device cannot be greatly reduced. Further, the slot antenna is usually a long rectangular metal frame, where there will be a long rectangular slot allocated being extended in the same direction as the long rectangular metal frame in the middle of the long rectangular metal frame. The vendors may tune a plate width between the long rectangular metal frame and the long rectangular slot, in order to adjust effects of high operating frequencies and low operating frequencies. However, in the aforementioned tuning, the location where the long rectangular metal frame corresponding to a short edge of the long rectangular slot has two tuning widths, while the location where the long rectangular metal frame corresponding to the a long edge of the long rectangular slot has fourth tuning widths. All these tuning widths will interactively influence characteristics of high operating frequencies and low operating frequencies. Therefore, the vendors require spending longer operation time for tuning the slot antenna to an expected operating frequency, which greatly lowers operation efficiency of the vendors.

Based upon the aforementioned, no matter a monopole antenna or a slot antenna, which are all limited by antenna characteristics thereof, cannot be properly designed for allocation communication devices of small volumes. Therefore, in order to revolve the aforementioned drawbacks of the conventional art, it is a major issue for related antenna design vendors to design an antenna with a shorter length and with operating frequency which can be easily tuned.

SUMMARY

The invention is directed to a monopole slot antenna structure.

Due to the fact that antenna structures of the existing communication devices are not perfect, which may damage marketing interests of the vendors, a monopole slot antenna structure is developed by the Applicant, which is disclosed in the invention, and the monopole slot antenna structure has a tuning slot section, so as to provide the vendor with an antenna having easily-tuned operating frequency and smaller volume.

According to an embodiment of the invention, a monopole slot antenna structure is provided. Mainly, the resonance frequency of the monopole slot antenna is a quarter of a wavelength of an operating frequency of the monopole slot antenna. Further, it can easily tune suitable operating frequency of the monopole slot antenna by changing a width of the slot section thereof, in order to achieve a simple tuning operation procedure. The monopole slot antenna structure includes a dielectric substrate, the monopole slot antenna and a feed element. The monopole slot antenna is disposed on one side of the dielectric substrate and has a slot. Also, the slot includes a first slot section, a tuning slot section and a second slot section. One end of the first slot section is located at one edge of the monopole slot antenna with the other end of the first slot section being extended towards internal portions of the monopole slot antenna and being connected to the tuning slot section. One end of the second slot section is connected to the tuning slot section with the other end of the second slot section being extended away from the first slot section. A length of the first slot section is less than or equal to a length of the second slot section. Moreover, the feed element is disposed correspondingly to the second slot section, and is configured for exciting the monopole slot antenna to generate a first operating frequency band and a second operating frequency band. Under the circumstance of increasing the width of the slot section, i.e. in a direction corresponding to an extending direction of the first slot section or the second slot section, the frequency corresponding to the second operating frequency is accordingly lowered. As such, the vendors can adjust the frequency of the second operating frequency band by changing the width of the slot, thereby enabling a communication device in which the monopole slot antenna structure of the invention is disposed therein to operate in an expected dual-frequency environment.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Since a monopole slot antenna has a resonance frequency of a quarter of a wavelength of its operating frequency, antenna length of the monopole slot antenna can be greatly reduced in comparison with a slot antenna. However, sensitivity of the monopole slot antenna is lower than that of the monopole antenna. It is disclosed that Applicant of the invention therefore designs a novel antenna structure whose operating frequency can be easily tuned by using the aforementioned characteristics of the monopole slot antenna.

Figure 1:
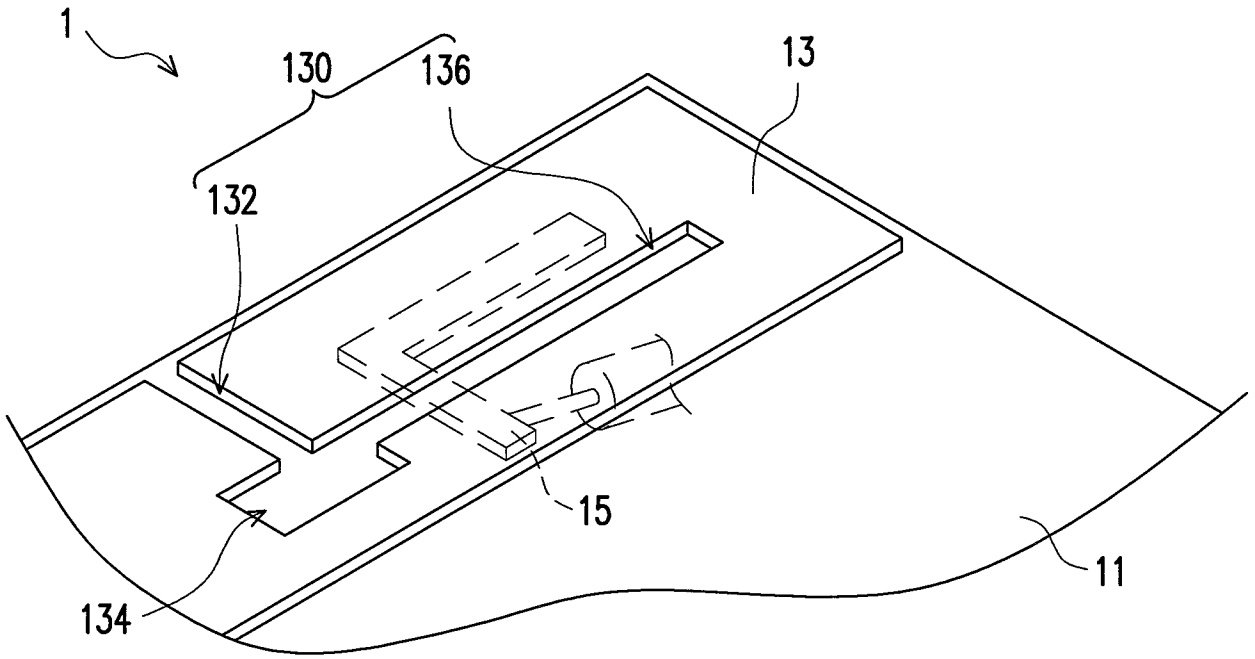
FIG. 1 is a schematic three-dimensional diagram of a monopole slot antenna structure according to an embodiment of the invention.
Figure 2:
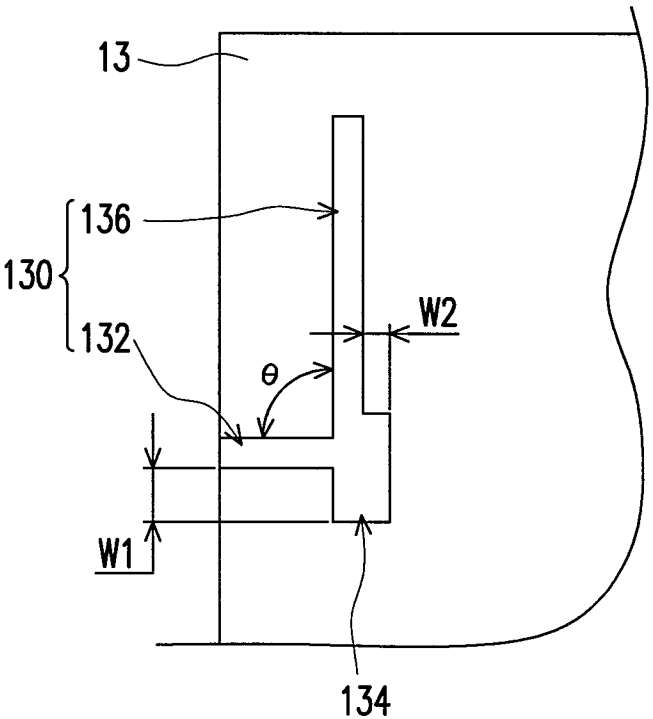
FIG. 2 is a schematic two-dimensional diagram of a monopole slot antenna structure according to an embodiment of the invention.

The invention provides a monopole slot antenna structure, which is applicable to a wireless communication device with dual-frequency operating functionality. Referring to FIG. 1, in a preferred embodiment of the invention, a monopole slot antenna structure 1 includes a dielectric substrate 11, a monopole slot antenna 13 and a feed element 15. The dielectric substrate 11 is a system electric circuit board of the wireless communication device, and the monopole slot antenna 13 is disposed on one side of the dielectric substrate 11 and has a slot 130. Also, the slot 130 includes a first slot section 132, a tuning slot section 134 and a second slot section 136. One end of the first slot section 132 is located at one edge of the monopole slot antenna 13 with the other end of the first slot section 132 being extended towards internal portions of the monopole slot antenna 13 and being connected to the tuning slot section 134. One end of the second slot section 136 is connected to the tuning slot section 134 with the other end of the second slot section 136 being extended away from the first slot section 132. There is an included angle θ between an extending direction of the second slot section 136 and an extending direction of the first slot section 132 so as to form a monopole slot antenna, as shown in FIG. 2. Meanwhile, a length L1 of the first slot section 132 is less than or equal to a length L2 of the second slot section 136 so that the monopole slot antenna 13 can operate in a dual-frequency environment. In the present embodiment, the included angle θ is 90 degrees such that the slot 130 has an L shape. However, it is noted that, in other embodiments of the invention, the included angle θ can be any degree to comply with design requirements of different products.

Following the aforementioned descriptions, referring back to FIG. 1, the feed element 15, for example, a micro-strip line, is disposed on the other side of the dielectric substrate 11 and located between the tuning slot section 134 and the other end of the second slot section 136. Moreover, the feed element 15 is disposed correspondingly to the second slot section 136, and is configured for exciting the monopole slot antenna 13 to generate a first operating frequency band (e.g., a lower frequency) and a second operating frequency band (e.g., a higher frequency) as a result of a design of the first slot section 132 and the slot section 136. However, in other embodiments of the invention, if the feed element 15 is a copper axial cable, the feed element 15 can be directly disposed on the monopole slot antenna 13, and located correspondingly to the second slot section 136. Thus, as long as the feed element 15 can excite the monopole slot antenna to generate two operating frequency bands, the feed element 15 is the feed element disclosed in the invention. Further, referring back to FIG. 2, a width W1 refers to a distance of the tuning slot section 134 in an extending direction corresponding to the second slot section 136. A width W2 refers to a distance of the tuning slot section 134 in an extending direction corresponding to the first slot section 132. Under the circumstance where the widths W1, W2 are both increased, the frequency of the second operating frequency band is accordingly increased. As such, the vendors can only tune one of the widths W1 and W2 of the tuning slot section 134 according to a space requirement of the electric circuit design and convenience. Alternatively, the vendors can also increase both widths W1 and W2 of the tuning slot section 134 at the same time, in order to easily control space planning of the electric circuit design.

Figure 3:
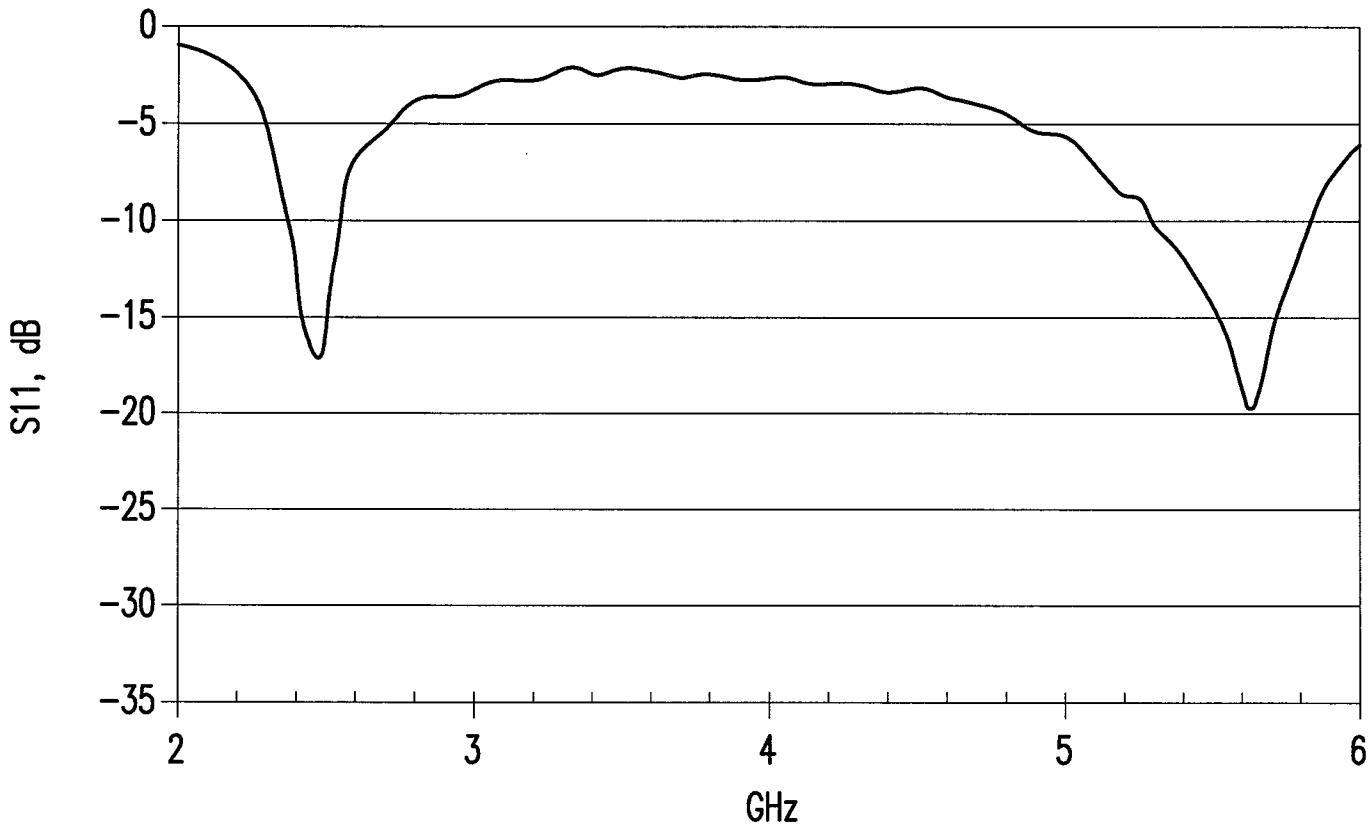
FIG. 3 illustrates measurement results of a reflection coefficient S11 of an embodiment of the invention.
Figure 4:
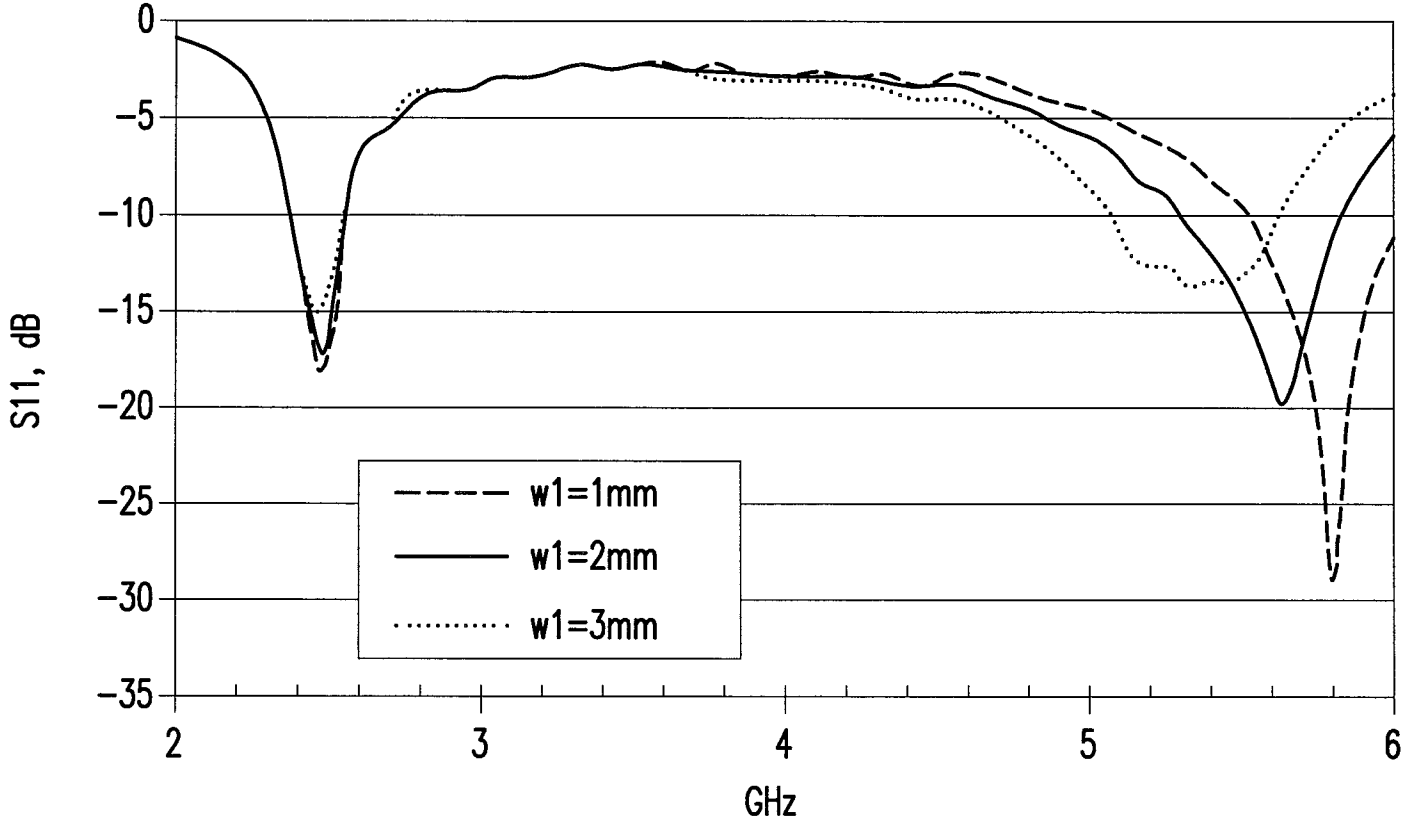
FIG. 4 is a schematic diagram comparing reflective coefficient S11 of embodiments with a varied width W1 in the invention.

In order to clearly illustrate characteristics of the monopole slot antenna 1 of the invention, and describe how the variations of the widths W1 and W2 of the tuning slot section 134 can actually influence corresponding operating frequency bands, the following embodiments are described with adjustments of the width W1 of the tuning slot section 134. Referring back to both FIG. 1 and FIG. 2, in the present embodiment, the length L1 of the first slot section 132 is 4.5 mm, and the length L2 of the second slot section 136 is 12.5 mm, such that the total length L of the slot 130 is 17 mm. Referring to measurement results of reflective coefficient S11 shown in FIG. 3, the monopole slot antenna in fact has two operating frequency bands. The first operating frequency band of the monopole slot antenna is approximately 2.4 GHz, and the second operating frequency band is approximately 5.6 GHz. Thus, the vendors can increase a distance (i.e., the width W1) of the tuning slot section 134 in an extending direction corresponding to the second slot section 136 according to design requirements. For example, the width W1 can be adjusted to be 1 mm, 2 mm or 3 mm. Referring back to FIG. 4, it can be understood by the measurement results of the reflective coefficient S11, when the width W1 of the tuning slot section 134 is increased, frequency of the second operating frequency band is accordingly lowered, which means that the frequency of the second operating frequency band is changed towards 5 GHz. As such, the vendors can adequately change the width W1 of the tuning slot section 134, so that the second operating frequency band of the monopole slot antenna structure 1 can operate in an operating frequency expected by the vendors.

Referring back to FIG. 1 and FIG. 2, when the width W2 of the tuning slot section 134 in an extending direction corresponding to the first slot section 132 is similarly increased, the frequency of the second operating frequency band is accordingly lowered. Accordingly, the vendors can only change the widths W1 or W2 of the tuning slot section 134, in order to tune the frequency of the second operating frequency band, thereby enabling the monopole slot antenna structure 1 to operate in dual-frequency environment as expected by the vendors. Further, in comparison of the conventional slot antenna structure having six tuning sections required to be tuned, only two widths W1 or W2 of the tuning slot section 134 are required to be tuned in the monopole slot antenna structure 1 of the invention. Therefore, the monopole slot antenna structure 1 of the invention is not only more convenient than the conventional slot antenna, but also is far smaller than the conventional slot antenna in terms of overall length. Thus, the monopole slot antenna structure 1 of the invention can enhance marketing competitiveness of the vendors.

Figure 5:
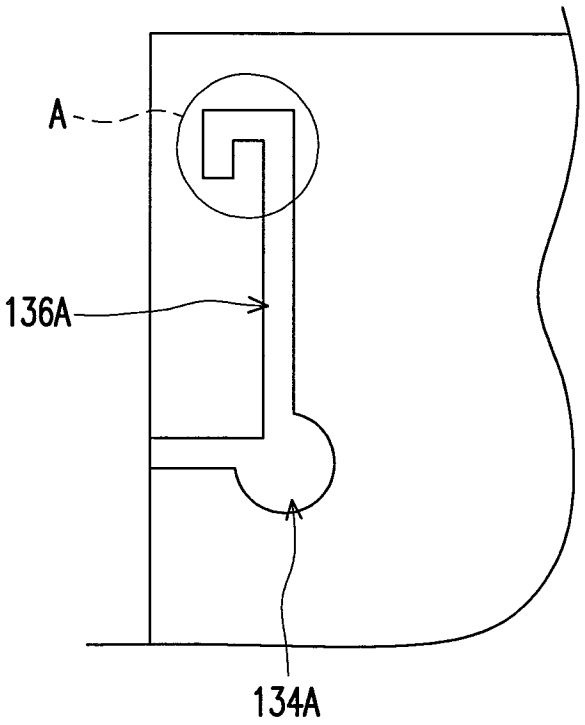
FIG. 5 is a schematic two-dimensional diagram of a monopole slot antenna structure according to another embodiment of the invention.

It is herein noted that, though the aforementioned embodiments are described with an example of the slot being in the L shape, in other embodiments of the invention, the vendors can make variations of the slot shape according to actual electric circuit requirements or frequency requirements. For example, referring to FIG. 5, the other end of the second slot section 136A can be bended to form an arc section A (for example, as shown in an enclosed dashed line of FIG. 5), so as to change the second operating frequency corresponding to the second slot section 136A, thereby enabling the monopole slot antenna structure of the invention to adapt to dual-frequency operating environments of different requirements. Thus, the monopole slot antenna structure of the invention can have higher industrial utility. In addition, the shape of the turning slot section disclosed in the invention is not limited to the rectangular shape in the aforementioned figures. In other embodiments of the invention, the vendors can change the turning slot section to be arc-shaped (for example, like the tuning slot section as shown in FIG. 6) or other shapes. Therefore, the vendors can have greater convenience in designing electric circuits.

It is noted that though the embodiments shown in FIG. 1 illustrating the feed element 15 being disposed correspondingly to the second slot section 136, and the dielectric substrate 11 being disposed between the monopole slot antenna 13 and the feed element 15, in other embodiments, the feed element 15 can be disposed correspondingly to the second slot section 136, and the monopole slot antenna 13 can be disposed between the dielectric substrate 11 and the feed element 15.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A monopole slot antenna structure, comprising:

a dielectric substrate;

a monopole slot antenna, disposed on one side of the dielectric substrate and having a slot, wherein the slot includes a first slot section, a tuning slot section and a second slot section, one end of the first slot section is located at one edge of the monopole slot antenna with the other end of the first slot section being extended towards internal portions of the monopole slot antenna and being connected to the tuning slot section, and one end of the second slot section is connected to the tuning slot section with the other end of the second slot section being extended away from the first slot section, wherein the first slot section has an opening that faces outward and is disposed on one end of the first slot section away from the tuning slot section such that the first slot section is in communication with an outside region; and a feed element, disposed correspondingly to the second slot section, for exciting the monopole slot antenna to generate a first operating frequency band and a second operating frequency band, wherein when a width of an extending direction of the tuning slot section corresponding to the second slot section is increased, a frequency of the second operating frequency band is accordingly decreased, and when a width of an extending direction of the tuning slot section corresponding to the first slot section is increased, a frequency of the second operating frequency band is accordingly decreased.

2. The monopole slot antenna structure as claimed in claim 1, wherein a length of the first slot section is less than or equal to a length of the second slot section.

3. The monopole slot antenna structure as claimed in claim 2, wherein a bended section is formed at the other end of the second slot section.

4. The monopole slot antenna structure as claimed in claim 1, wherein the feed element is disposed correspondingly to the second slot section, and the dielectric substrate is disposed between the monopole slot antenna and the feed element.

5. The monopole slot antenna structure as claimed in claim 1, wherein the feed element is disposed correspondingly to the second slot section, and the monopole slot antenna is disposed between the dielectric substrate and the feed element.

6. The monopole slot antenna structure as claimed in claim 1, wherein the tuning section is a rectangle.

7. The monopole slot antenna structure as claimed in claim 1, wherein the tuning section is an arc.

8. The monopole slot antenna structure as claimed in claim 1, wherein the feed element is disposed under the second slot section.

* * * * *